US005573469A

United States Patent [19]

Dekura

[11] Patent Number: 5,573,469

[45] Date of Patent: Nov. 12, 1996

[54] GULF CLUB HEAD

[75] Inventor: Shoichi Dekura, Tokyo, Japan

[73] Assignee: Daiwa Seiko, Inc., Tokyo, Japan

[21] Appl. No.: 509,857

[22] Filed: Aug. 1, 1995

[30] Foreign Application Priority Data

Aug. 5, 1994 [JP] Japan ..... 6-184722

[51] Int. Cl.[6] ..... A63B 53/04

[52] U.S. Cl. ..... 473/314; 473/324; 473/328; 473/344; 473/345

[58] Field of Search ..... 273/167 H; 473/314, 473/324, 328, 344, 345

[56] References Cited

U.S. PATENT DOCUMENTS 1,868,286 7/1932 Grieve ..... 273/174

5,354,055 10/1994 MacKeil ..... 273/167 H X 5,380,010 1/1995 Werner et al. ..... 273/167 H 5,452,890 9/1995 Bingman ..... 273/167 H X

*Primary Examiner*—George J. Marlo

*Attorney, Agent, or Firm*—Longacre & White

[57] ABSTRACT

This invention relates to a golf club head which can be stably placed on the ground at address so that a face of the head can be properly directed toward a ball. In a golf club head, a convex portion is formed on a sole of a head body, and when the head body is inclined an angle of 5°~20° from a lie angle to bring a heel of the head body toward the ground, the convex portion is brought into contact with the ground at a face side, a back side and a toe side of a point of intersection between the sole and an axis of a shaft connected to the head body.

9 Claims, 6 Drawing Sheets

GULF CLUB HEAD

BACKGROUND OF THE INVENTION

This invention relates to a golf club head, and more particularly to a golf club head which can be stably placed on the ground at address so that a face of the head can be properly directed toward a ball.

Generally, a head body of a golf club head called "wood" is formed of various materials such as natural wood (e.g. persimmon or cherry) or metal (e.g. stainless steel or an aluminum alloy), and such a metal head is cast into a hollow construction.

FIGS. 11 and 12 shows a golf club head disclosed in U.S. Pat. No. 1,868,286. In this golf club head, a sole plate 7 of metal is fixedly secured by bolts to a sole portion 5 of a head body 3 formed of wood.

For allowing the golf club head to better glide through the ground when hitting a ball, a convex portion 9 of a generally T-shape is formed on the sole plate 7 as shown in FIG. 12, and this convex portion 9 has a face-side convex portion 9*a* slightly curved along the contour of a face-side portion of the sole portion 5, and a center convex portion 9*b* extending from this face-side convex portion 9*a* toward a back side through a generally central portion of the sole plate 7. An area of contact of the sole plate 7 with the ground 11 is reduced by thus forming the generally T-shaped convex portion 9 on the sole plate 7, and with this construction there is obtained an advantage that the golf club head 1 is allowed to easily glide through the ground.

Incidentally, at address, the average golf player usually puts the golf club head 1 on the ground 11 in such an inclined manner that its heel 1*a* is disposed closer to the ground as shown in phantom in FIG. 11 for fear of getting a slice.

A golfer tends to dispose the heel 1*a* closer to the ground in an attempt to avoid a slice. When disposing the heel 1*a* closer to the ground, the lie angle θ is usually reduced by 5°–20°. See FIG. 11.

However, when reducing the lie angle θ, to bring the heel 1*a* closer to the ground, the golf club head 1 is caused to roll at the face-side convex portion 9*a*. Thus, because the face-side convex portion 9*a* is curved along the contour of the sole 5 as described above, the golf club head 1 can not be stably positioned on the ground 11.

In addition, a face portion of a golf club head is usually inclined upwardly with respect to a sole to provide a loft angle so that a ball can fly. However, when the golf club head 1 is caused to roll at the face-side convex portion 9*a*, when bringing the heel 1*a* closer to the ground as described above, the angle of the face is varied. Thus the loft angle is changed since the face-side convex portion 9*a* is slightly curved.

Therefore, a golf club head capable of being stably positioned on the ground at address has been desired among golf players and particularly beginners.

SUMMARY OF THE INVENTION

The present invention has been made in view of the above problems, and an object of the invention is to provide a golf club head which can be stably placed on the ground at address so that a face of the head can be properly directed toward a ball.

The above object has been achieved by a golf club head, according to the invention, in which a convex portion is formed on a sole of a head body; and when the head body is inclined an angle of 5°~20° from a lie angle to bring a heel of the head body toward the ground, the convex portion is brought into contact with the ground at a face side, a back side and a toe side of a point of intersection between the sole and an axis of a shaft connected to the head body.

In a feature of the invention, points of contact of the convex portion with the ground at the face side and the back side of the intersection point are disposed closer to the heel side than the intersection point is.

In a feature of the invention, the convex portion is formed in a discontinuous manner or a continuous manner.

In a feature of the invention, that portion of the convex portion disposed at the toe side of the intersection point is defined by a flat surface extending from the face side to the back side.

In the golf club head, when the golf player inclines the golf club head an angle of 5°~20° from the lie angle to bring the heel closer to the ground at address, the contact portions of the convex portion formed on the sole are brought into contact with the ground at the same time, so that the golf club head is positioned on the ground in a stationary condition.

In the golf club head in which that portion of the convex portion disposed at the toe side of the intersection point is defined by a flat surface extending from the face side to the back side, during swing the whole of the sole portion is not brought into contact with the ground, but only the flat portion of the convex portion disposed at the toe side of the intersection point is brought into contact with the ground.

DETAILED DESCRIPTION OF THE PREFERRED EMBODIMENTS

A preferred embodiment of the present invention will now be described with reference to the drawings.

Figure 1:
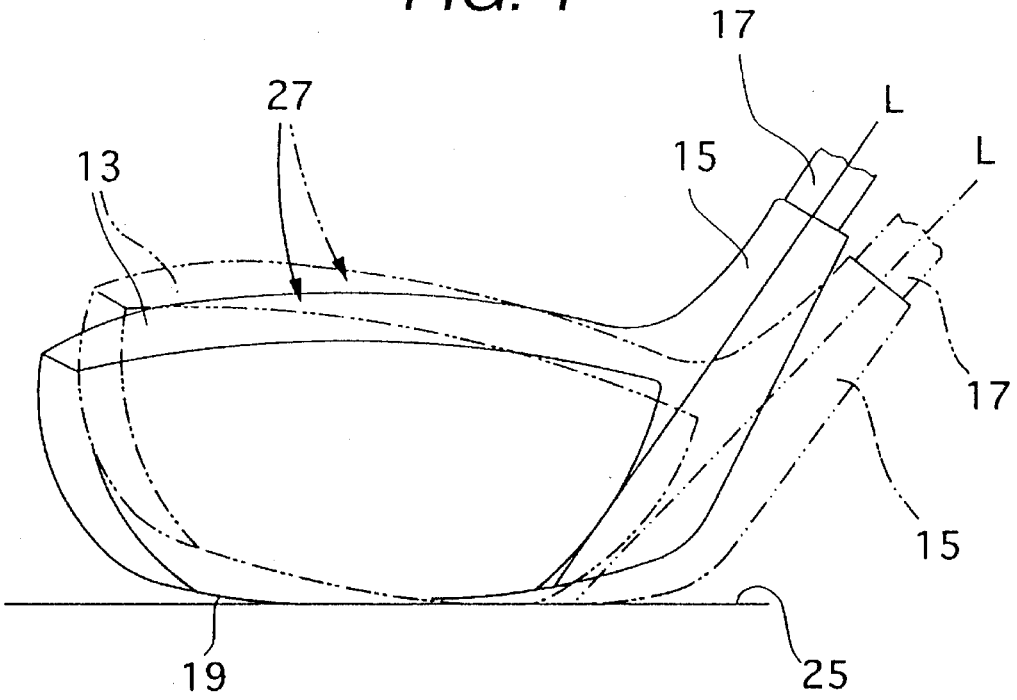
FIG. 1 is a front-elevational view of one preferred embodiment of a golf club head of the invention.

FIGS. 1 to 5 show one preferred embodiment of a golf club head. In FIG. 1, a hollow head body 13 is cast of metal such as stainless steel, a magnesium alloy and an aluminum alloy. A shaft 17, formed of metal or a synthetic resin such as FRP is inserted into a hosel portion 15 cast integrally with the head body 13 at a heel side thereof.

Figure 2:
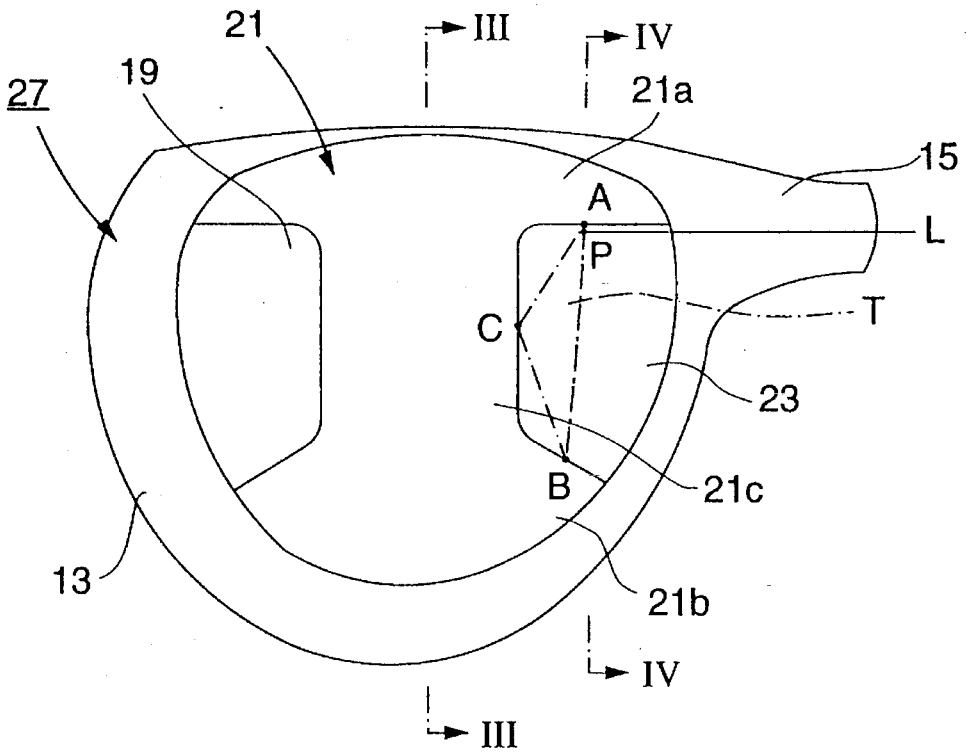
FIG. 2 is a bottom view of the golf club head of FIG. 1.
Figure 3:
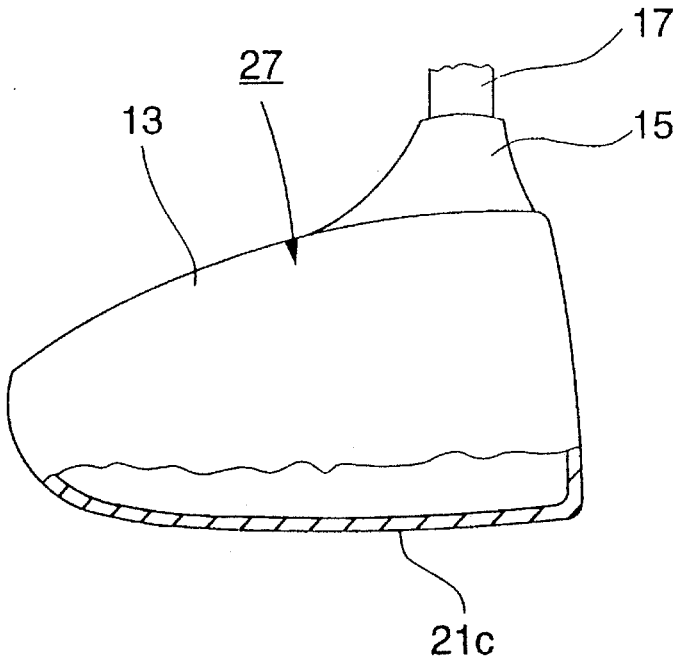
FIG. 3 is a partly-broken, cross-sectional view taken along the line III—III of FIG. 2.
Figure 4:
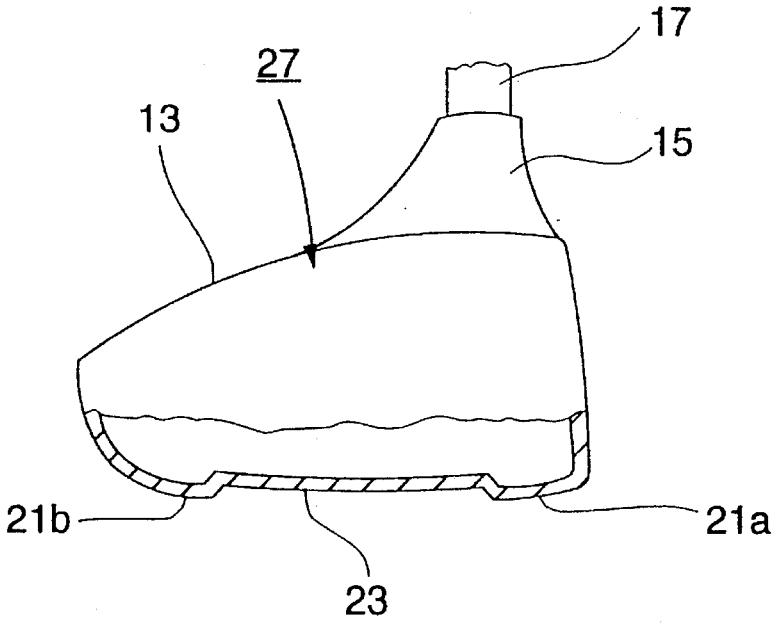
FIG. 4 is a partly-broken, cross-sectional view taken along the line IV—IV of FIG. 2.

In FIG. 2, reference character P denotes a point of intersection between an axis L of the shaft 17 and a sole portion 19 of the head body 13. A convex portion 21 of a generally H-shape is formed on the sole portion 19, and extends from a toe side to the heel side, and this convex portion 21 is slightly curved from a face side toward a back side as shown in FIGS. 3 and 4. The convex portion 21 is constituted by a face-side convex portion 21*a*, a back-side convex portion 21*b* and a center convex portion 21*c* interconnecting the two convex portions 21*a* and 21*b*. The intersection point P is disposed at a heel-side recess portion 23 generally surrounded by the three convex portions 21*a*, 21*b* and 21*c*.

Figure 5:
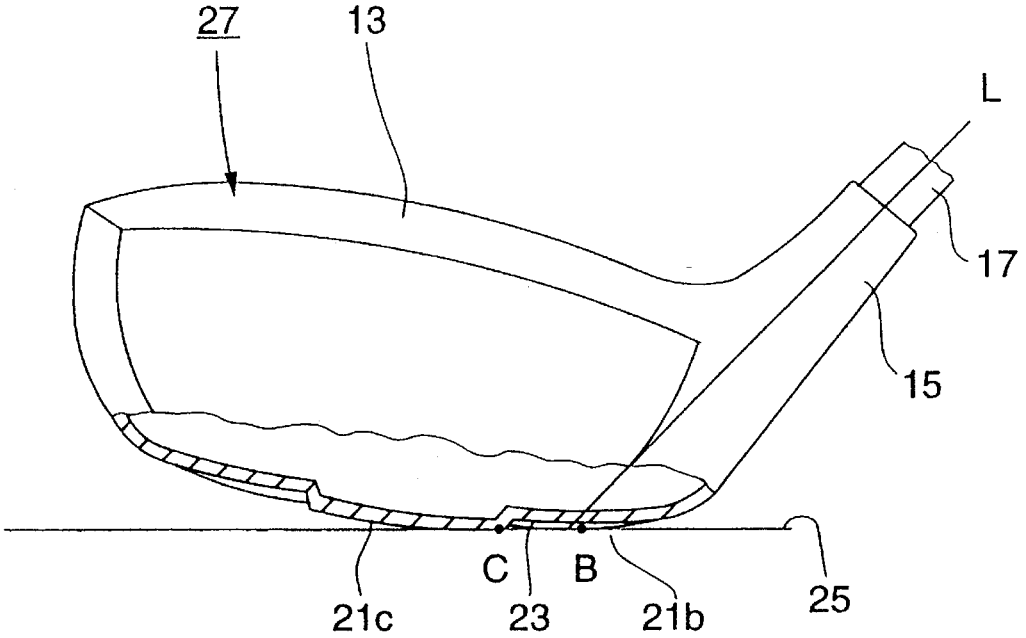
FIG. 5 is a partly-broken, front-elevational view showing a positioned condition of the golf club head in which the golf club head is inclined in a direction to bring the heel toward the ground at address.

When the head body 13 is inclined an angle of 5°~20° from the lie angle to bring its heel closer to the ground as shown in phantom in FIG. 1, contact points A, B and C of the convex portions 21*a*, 21*b* and 21*c* are brought into contact with the ground 25 at the same time as shown in FIG. 5, so that the head body 13 is positioned on the ground 25 in a stationary condition without varying a face angle.

As shown in FIG. 2, the points A and B of contact of the face-side convex portion 21*a* and the back-side convex portion 21*b* with the ground 25 are disposed closer to the heel side than the intersection point P, and the intersection point P is disposed within a triangle T formed by lines interconnecting the contact points A, B and C.

With this construction of the golf club head 27 of this embodiment, when the golf player inclines the golf club head 27 an angle of 5°~20° from the lie angle to bring the heel closer to the ground at address as shown in phantom in FIG. 1, the contact points A, B and C of the convex portions 21*a*, 21*b* and 21*c* are brought into contact with the ground 25 at the same time, thereby holding the golf club head 27 in a stationary condition, thus positioning the golf club head 27.

Therefore, in this embodiment, when the golf club head 27 is inclined to bring the heel closer to the ground at address, the golf club head 27 can be positioned on the ground 25 in a stable manner, so that the face of the head can be properly directed toward a ball more easily than the conventional club head, and besides there is no fear that the loft angle is varied as a result of change of the face angle.

Figure 6:
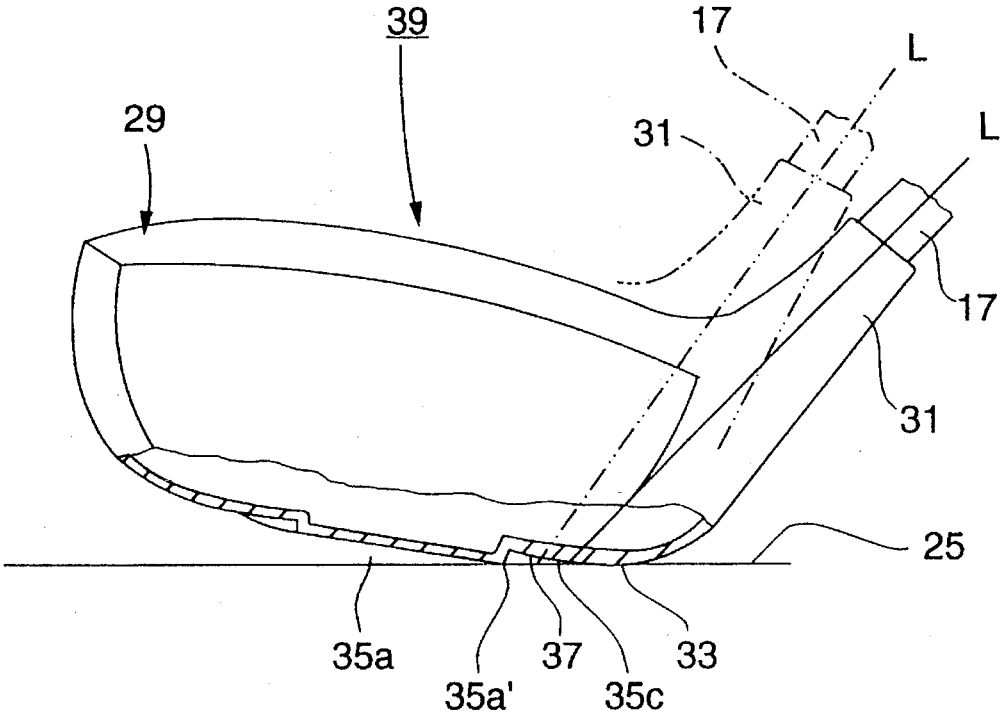
FIG. 6 is a partly-broken, front-elevational view showing a positioned condition of a golf club head with a flat center portion of the invention in which the golf club head is inclined in a direction to bring its heel toward the ground at address.
Figure 7:
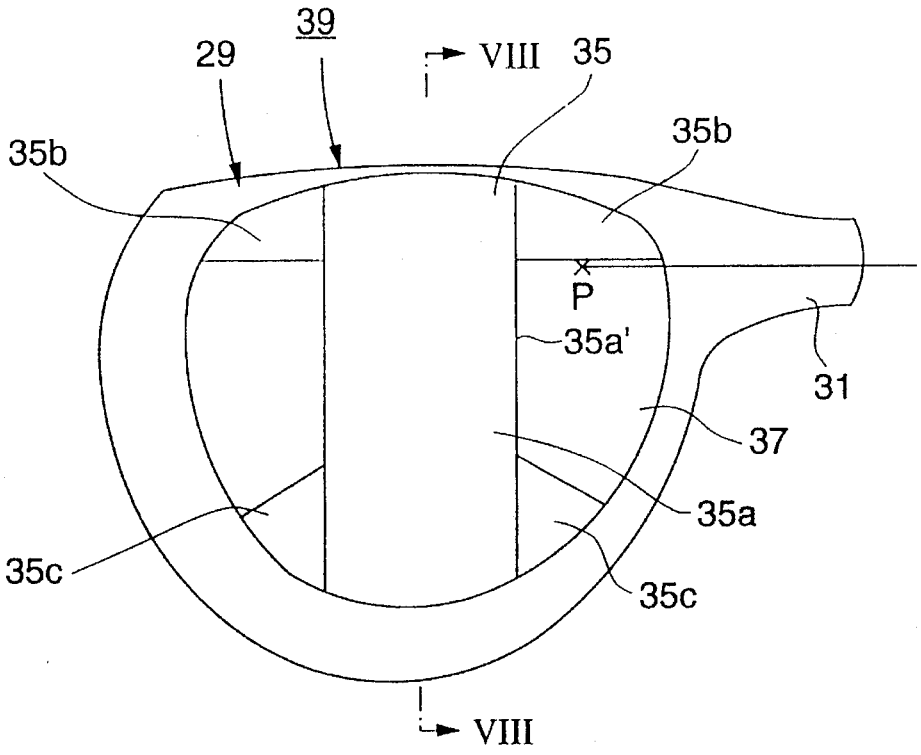
FIG. 7 is a bottom view of the golf club head of FIG. 6.
Figure 8:
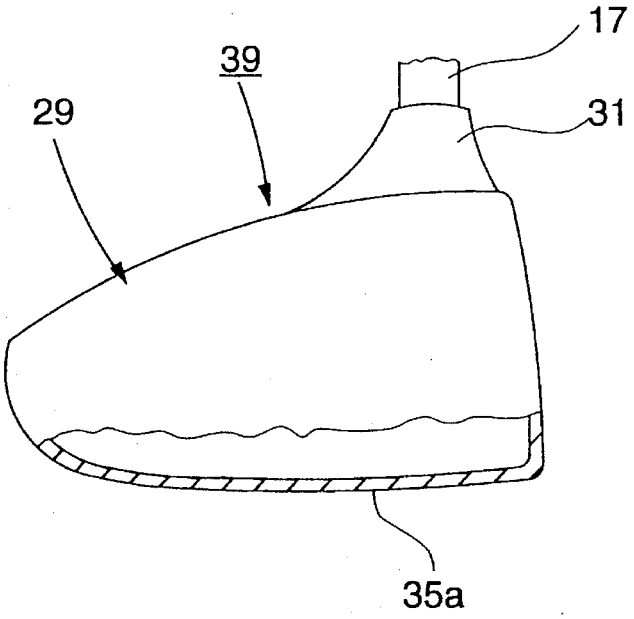
FIG. 8 is a partly-broken, cross-sectional view taken along the line VIII—VIII of FIG. 7.

FIGS. 6 to 8 shows another preferred embodiment of a golf club head of the invention. In FIG. 6, a hollow metal head body 29 is cast of the same material as that of the above-mentioned head body 13, and a shaft 17 is inserted into a hosel portion 31 cast integrally with the head body 29 at a heel side thereof.

In FIG. 7, reference character P denotes a point of intersection between an axis L of the shaft 17 and a sole portion 33 of the head body 29. As in the preceding embodiment, a portion 35 of a generally H-shape is formed on the sole portion 33 of the head body 29, and extends from a toe side to the heel side, and the intersection point P is disposed in a toe-side recess portion 37 generally surrounded by a center portion 35*a*, a face-side portion 35*b* and a back-side portion 35*c*, which jointly constitute the portion 35.

As shown in FIGS. 7 and 8, the center portion 35*a* is disposed at a generally central portion of the sole portion 33, and the surface of this portion 35*a* is flat from the face side to the back side, and during swing, the whole of the sole portion 33 is not brought into contact with the ground 25, but only the center portion 35*a* is brought into contact with the ground 25, thus reducing the area of contact between the sole portion 33 and the ground 25.

As shown in FIG. 6, the face-side portion 35*b* extending from the center portion 35*a* has two flat surfaces slanting toward the toe side and the heel side, respectively, and similarly the back-side portion 35*c* extending from the center portion 35*a* has two flat surfaces slanting toward the toe side and the heel side, respectively. When the head body 29 is inclined an angle of 5°~20° from the lie angle to bring its heel closer to the ground as shown in solid lines in FIG. 6, the face-side portion 35*b*, the back-side 35*c* and a heel-side side edge 35*a*' of the center portion 35*a* are brought into contact with the ground 25 at the same time, so that the head body 29 is positioned on the ground 25 in a stationary condition without varying a face angle.

With this construction of the golf club head 39 of this embodiment, when the golf player inclines the golf club head 39 an angle of 5°~20° from the lie angle to bring the heel closer to the ground at address as in the preceding embodiment, the face-side portion 35*b*, the back-side portion 35*c* and the heel-side side edge 35*a*' of the center portion 35*a* are brought into contact with the ground 25 at the same time, so that the head body 29 is positioned on the ground 25 in a stationary condition without varying the face angle.

During swing, the whole of the sole portion 33 is not brought into contact with the ground 25, but only the center portion 35*a* is brought into contact with the ground 25.

Therefore, in this embodiment, also, when the golf club head 39 is inclined to bring the heel closer to the ground at address, the golf club head 39 can be positioned on the ground 25 in a stationary condition, and besides there is no fear that the loft angle is varied as a result of change of the face angle. Therefore, the golf club head 39 can be positioned on the ground in a stable manner, so that the face of the head can be properly directed toward a ball.

Furthermore, in this embodiment, during swing, the whole of the sole portion 33 is not brought into contact with the ground 25, but only the center portion 35*a* is brought into the ground 25, as described above. Therefore, the area of contact between the sole portion 33 and the ground 25 is smaller than that obtained with the preceding embodiment, which provides an advantage that the golf club head can better glide through the ground.

Figure 9:
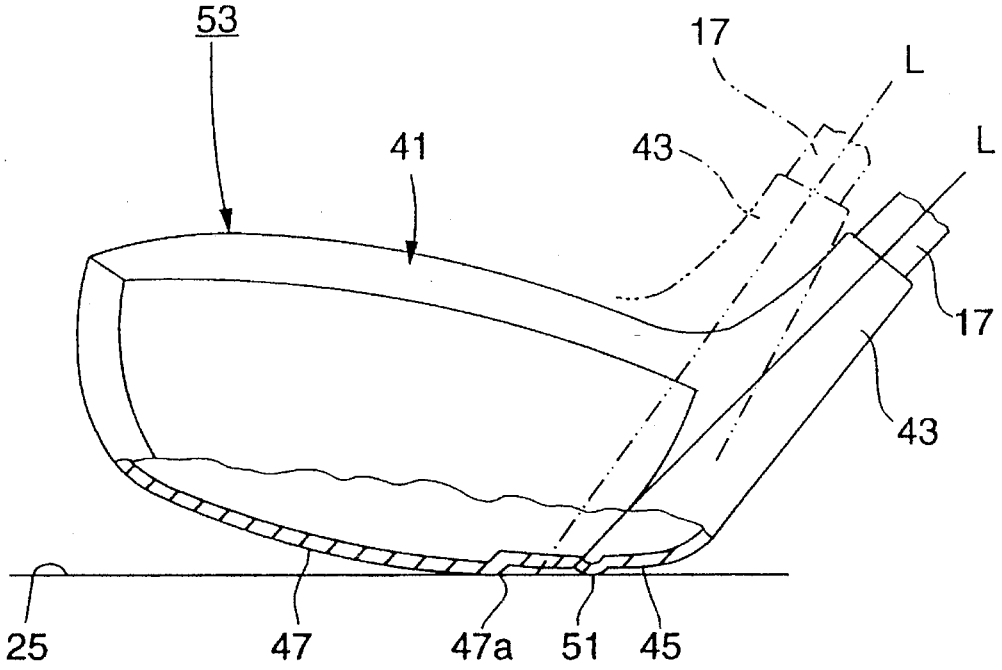
FIG. 9 is a partly-broken, front-elevational view showing a positioned condition of a golf club head of the invention in which the golf club head is inclined in a direction to bring its heel toward the ground at address.
Figure 10:
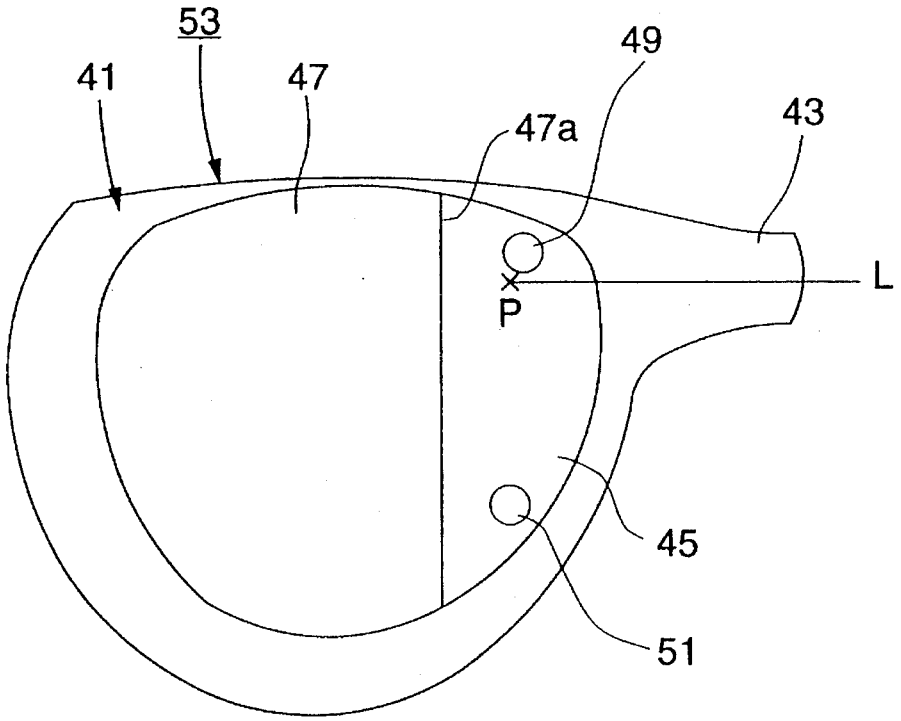
FIG. 10 is a bottom view of the golf club head of FIG. 9.
Figure 11:
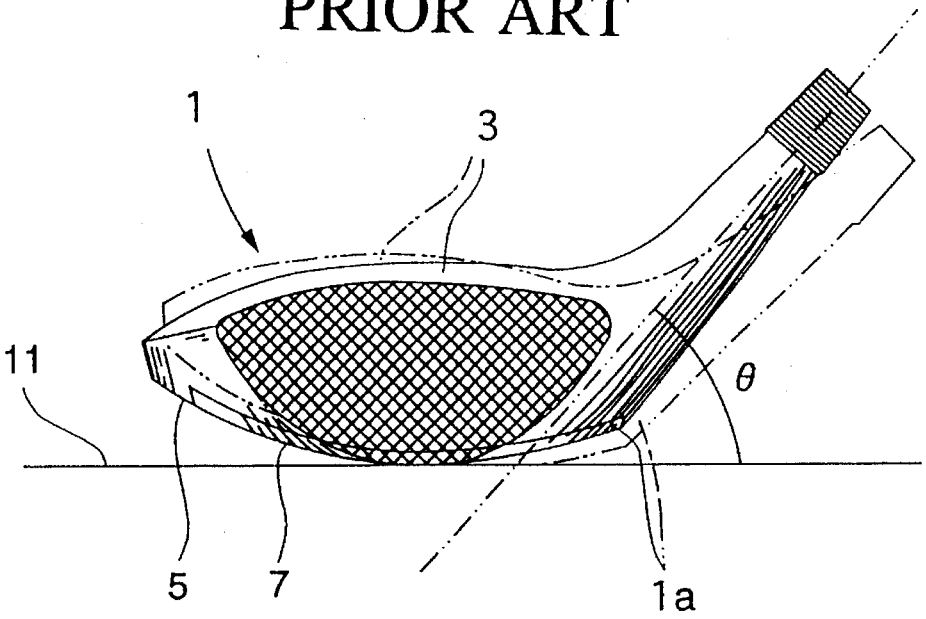
FIG. 11 PRIOR ART
FIG. 11 is a front-elevational view of a conventional golf club head.
Figure 12:
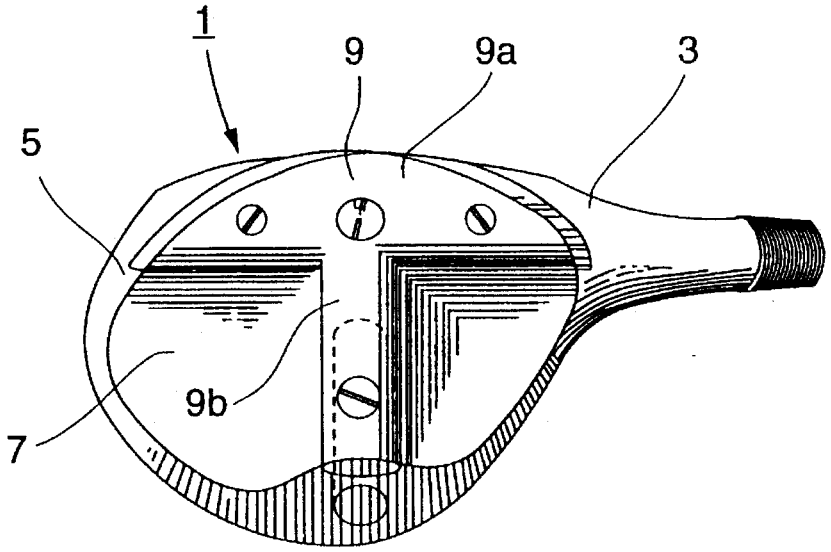
FIG. 12 PRIOR ART
FIG. 12 is a bottom view of the golf club head of FIG. 11.

FIGS. 9 and 10 show a further embodiment of a golf club head. In FIG. 9, a hollow metal head body 41 is cast of the same material as that of the head body 13 of FIG. 1, and a shaft 17 is inserted into a hosel portion 43 cast integrally with the head body 41 at a heel side thereof.

In FIG. 10, reference character P denotes a point of intersection between an axis L of the shaft 17 and a sole portion 45 of the head body 41. A portion 47 is formed on the sole portion 45 at a toe side of the intersection point P, and this portion 47 is curved along the sole portion 45. A heel-side side edge 47*a* of the portions 47 extends straight from a face side to a back side. Convex portions 49 and 51 each in the form of a projection are formed on the sole portion 45, and are disposed at the face side and heel side of the intersection portion P, respectively, the portions 49 and 51 being disposed adjacent to the heel. The intersection point P is disposed within a triangle defined by lines interconnecting a point along the side edge 47*a* and the portions 49 and 51.

When the head body 41 is inclined an angle of 5°~20° from the lie angle to bring its heel closer to the ground as shown in solid lines in FIG. 9, the side edge 47*a* and the portions 49 and 51 are brought into contact with the ground 25 at the same time, so that the head body 41 is positioned on the ground 25 in a stationary condition without varying a face angle.

With this construction of the golf club head 53 of this embodiment, when the golf player inclines the golf club head 53 an angle of 5°~20° from the lie angle to bring the heel closer to the ground at address, the side edge 47*a* of the portion 47 and the portions 49 and 51 are brought into contact with the ground 25 at the same time, so that the golf club head 53 is positioned on the ground 25 in a stationary condition without varying the face angle.

Therefore, in this embodiment, also, when the golf club head 53 is inclined to bring the heel closer to the ground at address, the golf club head 53 can be positioned on the ground 25 in a stationary condition, and thus the golf club head 53 can be positioned stably on the ground 25 so that the face of the head can be properly directed toward a ball, and besides there is no fear that the loft angle is varied as a result of change of the face angle.

In the golf club head as recited in claim 1, when the golf club head is inclined in a direction to bring the heel toward the ground at address, the golf club head can be positioned on the ground in a stationary condition, and therefore the golf club head can be stably positioned on the ground so that the face of the head can be properly directed to a ball, and besides there is no fear that the loft angle is varied as a result of change of the face angle.

In the golf club heads as recited in claims 2, 3 and 4, the point of intersection between the shaft axis and the sole portion is disposed within the area defined by lines interconnecting the points of contact of the portion with the ground, and therefore the golf club head can be positioned on the ground more stably.

In the golf club head as recited in claim 5, during swing, the whole of the sole portion is not brought into contact with the ground, and the area of contact of the sole portion with the ground is small, which provides an advantage that the golf club head can better glide through the ground.

What is claimed is:

1. A golf club head having a heel side, a toe side, a face side, and a back side, said club head comprising;

a sole portion; and a hosel portion for receiving a shaft, said hosel portion having an axis which is angled with respect to a ground surface to define a lie angle; said lie angle further defining a normal lie angle when said club head is positioned substantially horizontal in relation to said ground surface;

wherein when said heel portion is brought toward said ground surface such that said lie angle is reduced within a range of between five to twenty degrees from said normal lie angle, said sole portion contacts said ground surface at at least three distinct points, a peripheral line connecting said distinct points defines a planar area, and said axis of said hosel intersecting said planar area at an intersection point.

2. A golf club head according to claim 1, wherein said at least three distinct points are located one each at a face side, a back side, and a toe side, said face side contact point and said back side contact point being each disposed closer to said heel side than said intersection point.

3. A golf club head according to claim 2, wherein said sole portion further comprises:

a pair of projections formed on said sole portion of said club head, one each of said projections being disposed at said front side contact point and said back side contact point.

4. A golf club head according to claim 2, wherein said sole portion comprises, a recess located between said toe side contact point and said heel side of said club head, said intersection point being disposed within said recess.

5. A golf club head according to claim 2, wherein said sole portion is of a shape from said heel side to said toe side.

6. A golf club head according to claim 1, wherein a portion of said sole portion located near said toe side contact point is defined by a flat surface extending from said face side to said back side.

7. A club head according to claim 1, wherein said sole portion further comprises:

a front sole portion a back sole portion a center sole portion transversely disposed between said front and said back sole portions, said center sole portion being flat in the direction defined between said front side and said back side; wherein when said club head is swung only said center convex portion contacts said ground surface.

8. A golf club head according to claim 1, wherein said convex portion is formed in a discontinuous manner.

9. A golf club head according to claim 1, wherein said convex portion is formed in a continuous manner.

* * * * *

UNITED STATES PATENT AND TRADEMARK OFFICE

CERTIFICATE OF CORRECTION

PATENT NO. : 5,573,469
DATED : November 12, 1996
INVENTOR(S) : Dekura Shoichi

It is certified that error appears in the above-indentified patent and that said Letters Patent is hereby corrected as shown below:

Title page, item [54] and col. 1. line 1, change "Gulf" to --Golf--.

Signed and Sealed this

Fourteenth Day of January, 1997

*Attest:*

*Attesting Officer*

BRUCE LEHMAN

*Commissioner of Patents and Trademarks*